US005850642A

United States Patent [19]

Foster

[11] Patent Number: 5,850,642

[45] Date of Patent: Dec. 22, 1998

[54] APPARATUS AND METHOD FOR APPLYING PROTECTIVE MATERIAL

[76] Inventor: Wilbur A. Foster, 1713 Camp Craft Rd., Austin, Tex. 78746-7319

[21] Appl. No.: 844,833

[22] Filed: Apr. 22, 1997

[51] Int. Cl.[6] ..... A61G 7/10; A61G 7/14

[52] U.S. Cl. ..... 5/81.1 C; 5/86.1

[58] Field of Search ..... 5/81.1 C–89.1, 5/81.1 R; 414/921

[56] References Cited

U.S. PATENT DOCUMENTS

| | | | |
|---|---|---|---|
| 4,087,873 | 5/1978 | Ohkawa | 5/81.1 C |
| 5,185,894 | 2/1993 | Bastert | 5/81.1 C |
| 5,540,321 | 7/1996 | Foster | 5/81.1 R |

*Primary Examiner*—Alex Grosz
*Attorney, Agent, or Firm*—Shaffer & Culbertson; J. Nevin Shaffer, Jr.

[57] ABSTRACT

An apparatus and method for applying protective material (48, 58) having a stand (12) and at least one support arm (14) moveably connected to the stand (12). At least a pair of counter-rotatable shafts (16 and 18) are connected with the support arm (14) and endless moveable belts (20) for moving objects (54) so that an upper and lower surface (38 and 40) are formed by the belts (20) and each surface moves together at the same time, in the same direction. The protective material insertion apparatus (32) includes pivotal moveable upper support tray (42) and stationary lower support platform (44). After moveable upper support tray (42) is open and sheet-like protective material (48) is inserted with an end (50) protruding therefrom, the moveable upper support tray (42) is closed. Once closed, end (50) is wrapped on top of moveable upper support tray (42). When object mover (10) is operated, end portion (50) moves with moveable belt (20) as it crawls underneath patient (54), thereby protecting the patient from contact with object mover (10) and vice versa. Alternatively, folded protective material (58) may be inserted with free ends (50 and 60) protruding. Upon operation of the object mover (10), free end (50) covers moveable upper support tray (42) and free end (60) covers stationary lower support platform (44) so that patient (54) is protected from contact with object mover (10) and object mover (10) is protected from contact with a supporting surface, such as bed (62), upon which patient (54) had lain.

4 Claims, 5 Drawing Sheets

APPARATUS AND METHOD FOR APPLYING PROTECTIVE MATERIAL

BACKGROUND OF THE INVENTION

This invention relates to an apparatus and method for applying protective material. In particular, the apparatus and method is utilized to insert sheet-like protective material underneath an object to be moved and between the object to be moved and an object moving device.

Many devices have been developed for moving objects. In particular, in a hospital setting, the movement of patients from their beds in order to carry out treatment in a remote location, or simply to clean the patient or the bed, is a day to day occurrence. My prior invention, U.S. Pat. No. 5,540,321, (hereby incorporated in whole by reference) provided a solution to the problem of how a single person can effectively move heavy objects, such as patients, without having to first roll, turn, or slide the patient, and further, it enables a single user to lift the patient clear of the bed, so that the bed linen can be changed subsequent to the move, for example. Nonetheless, a problem remained in that it is desirous to be able to place the patient directly onto a clean linen, thereby protecting the patient and the moving equipment from contamination. Further, it is desirous to protect not only the top of the moving equipment upon which the object to be moved is placed but, also, the bottom of the object mover that comes in contact with the support upon which the object had been resting, i.e., a bed.

Thus, there is a need in the art for providing a means and method which enables the application of a protective material between an object to be moved and an object mover and further, which not only protects the top of the object mover from contact with the object being moved, but also, the bottom of the object mover from contact with the support upon which the object had been resting. It, therefore, is an object of this invention to provide an apparatus and method for applying protective material in between the object to be moved and the object mover in a safe, efficient, and non-obtrusive manner.

SHORT STATEMENT OF THE INVENTION

Accordingly, the apparatus for applying protective material of the present invention includes a moveable support stand to which a stationary lower support platform and endless belt means are connected. A moveable upper support tray and endless belt means are pivotally joined to the stationary lower support platform without interior obstruction so that protective material placed between them is free to move. The protective material can be one of any desirable type, including but not limited to any sheet-like protective material such as foam plastic, absorbent padding, waterproof sheets, and/or sheet-like protective material of any desired characteristic.

A method for applying protective material includes the step of connecting a stationary lower support platform and endless belt means to a moveable support stand. Next, a moveable upper support tray with an endless belt means is pivotally connected to the stationary lower support platform without interior obstruction so that protective material placed between them is free to move. Thereafter, the moveable upper support tray is pivoted to the open position and protective material is inserted between it and the stationary lower support platform. Next, the moveable upper support tray is closed and a leading edge of the protective material is folded over the top of it. At that point, simultaneous movement of the endless belt means and moving the support stand under the object to be moved ensures that the moveable upper support tray crawls underneath the object to be moved at the same time that the protective material moves with its endless belt means between the object to be moved and the moveable upper support tray. In another embodiment, the protective material is folded so that two free ends protrude with one end folded over the moveable upper support tray and one end folded back under the stationary lower support platform. Upon operation of the object mover, the protective material not only is inserted between and protects the patient from contact with the moveable upper support tray, but the stationary lower support platform is also protected from contact with the object upon which the object to be moved was resting, such as a bed.

BRIEF DESCRIPTION OF THE DRAWINGS

Other objects, advantages, and features of the present invention will become more fully apparent from the following detailed description of the preferred embodiment, the appended claims and the accompanying drawings in which:

DETAILED DESCRIPTION OF THE PREFERRED EMBODIMENT

Figure 1:
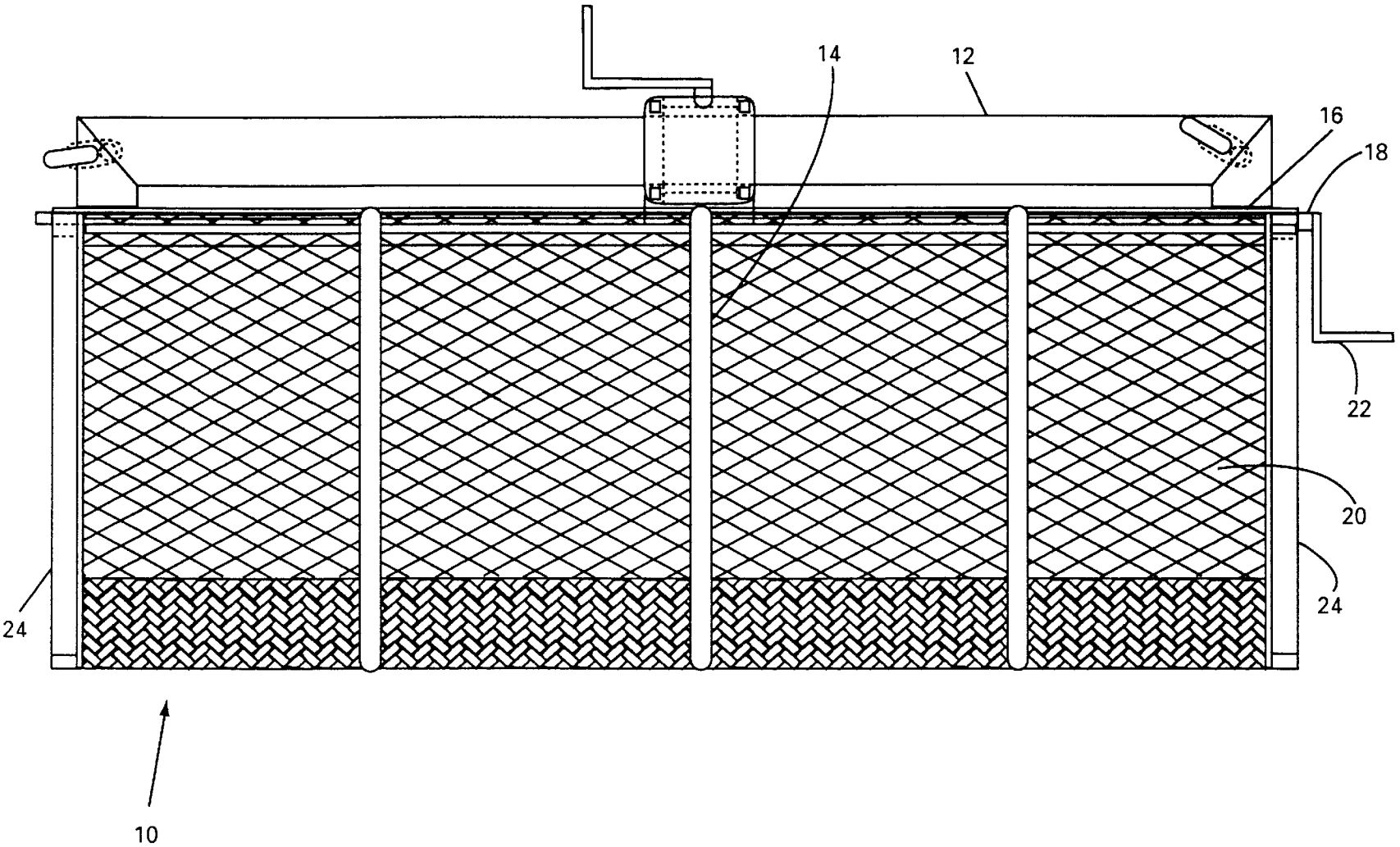
FIG. 1 is a top view of a preferred embodiment of the apparatus for applying protective material of the present invention.
Figure 2:
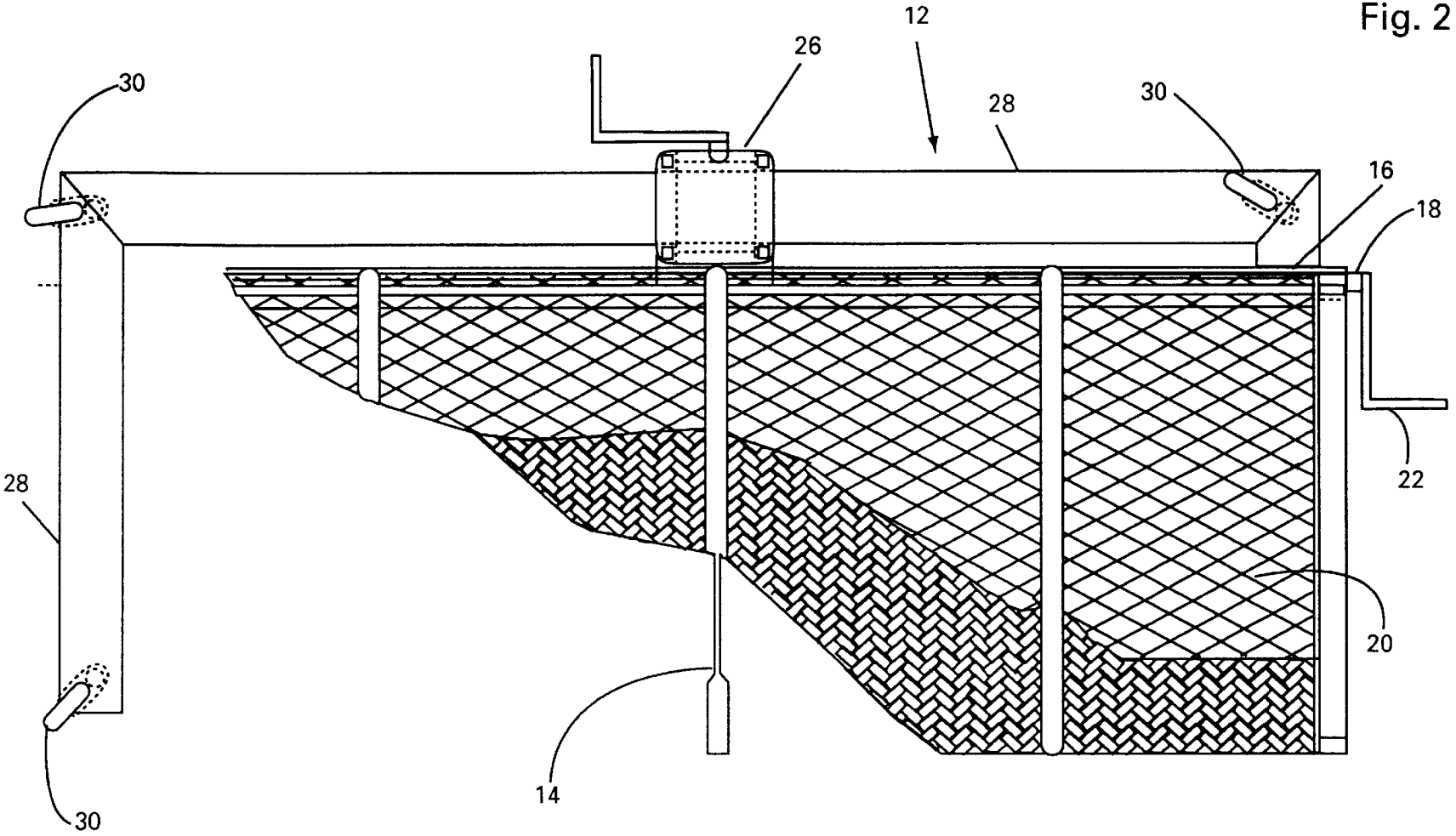
FIG. 2 is a top cut-away view of FIG. 1.

The preferred embodiment of the present invention is illustrated by way of example in FIGS. 1–10. With specific reference to FIGS. 1–3, an object mover 10 includes a stand 12 in the form, as seen from the side, of an L-shape to which is moveably connected at least one support arm 14 (three are shown in FIGS. 1 and 2). A pair of counter-rotatable shafts 16 and 18 are connected to the support arm 14. An endless moveable belt 20 encompasses each rotatable shaft 16 and 18. Further, a means for moving the counter-rotatable shaft, handle 22, is shown. A pair of end support tubes 24 is shown, within which are located the ends of counter-rotatable shafts 16 and 18. Support tubes 24 help support the moveable belts 20 against side to side motion.

Referring now to FIG. 2, stand 12 consists of upright vertical section 26 and horizontal sections 28. Horizontal sections 28 have casters 30 that enable ease of movement.

Figure 3:
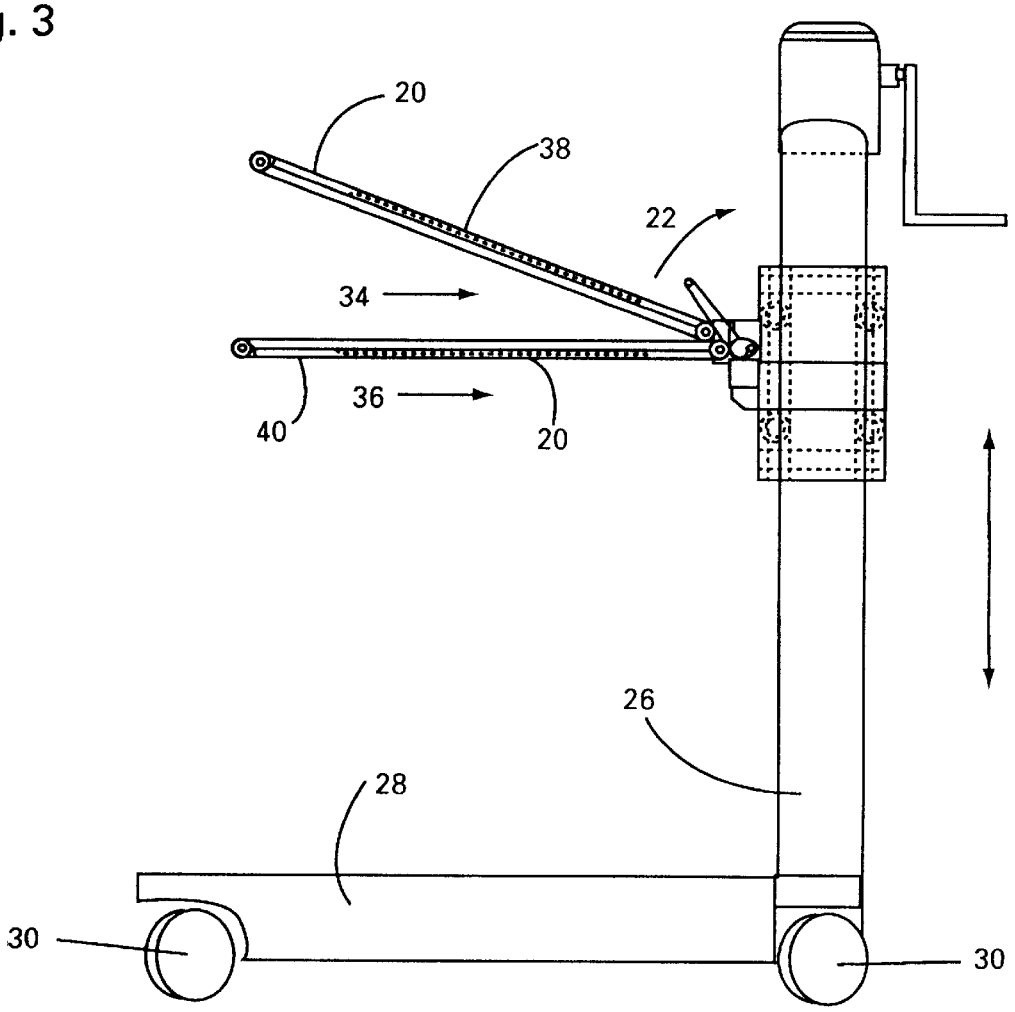
FIG. 3 is a side view of FIG. 1.

FIG. 3 shows arrows 34 and 36 which indicate that the top surface 38 of moveable belt 20 and the bottom surface 40 of a separate, but identical moveable belt 20, both move in the same direction when moved, such as when handle 22 is turned. It should be noted that the direction of arrows 34 and 36 will be reversed upon reversing the direction of movement of the object mover 10 and/or handle 22. That is, the belts will move upon contact whether the handle 22 is moved or not and is an additional method of moving the belts 20. However, obviously, it is preferred to have manual control of the movement of the belts 20 by means of handle 22, or the like.

Figure 4:
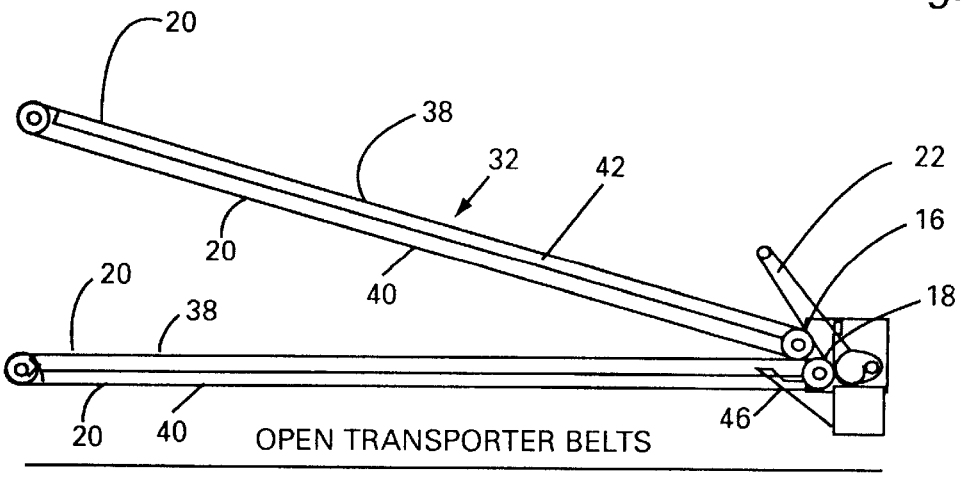
FIG. 4 is a side view of the moveable upper support tray and endless belt, and the stationary lower support platform and endless belt in the open position.

Referring now to FIGS. 4, 5, 6, and 7, an enlarged view of the protective material insertion apparatus 32 of the present invention, is shown. Protective material insertion apparatus 32 includes moveable upper support tray 42 and stationary lower support platform 44. Moveable upper support tray 42 is pivotally connected at point 46 to stationary lower support platform 44. Pivotal connection 46, of any type known in the art, enables moveable upper support tray 42 to be raised and lowered. FIG. 4 illustrates moveable upper support tray 42 in the raised or open position.

Figure 5:
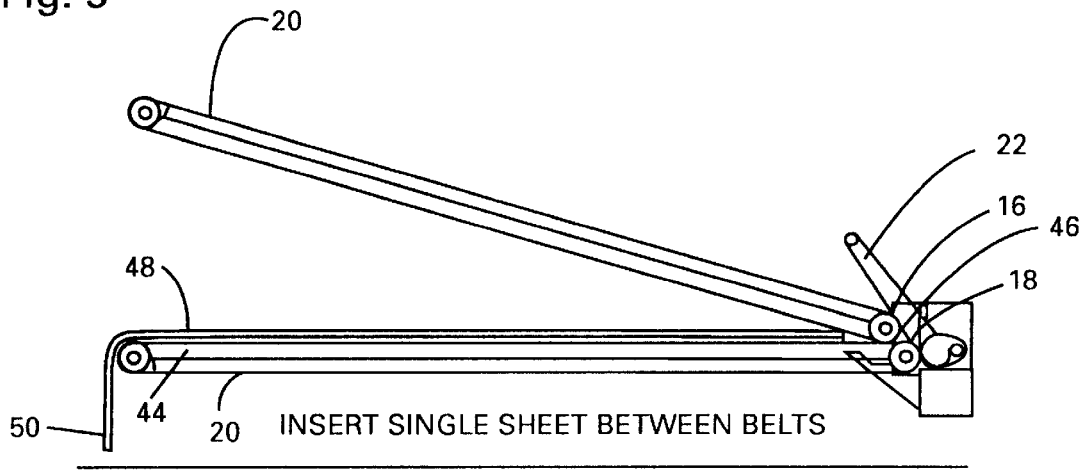
FIG. 5 is a side view as in FIG. 4 and shows a single sheet of protective material inserted between the endless belt means.
Figure 6:
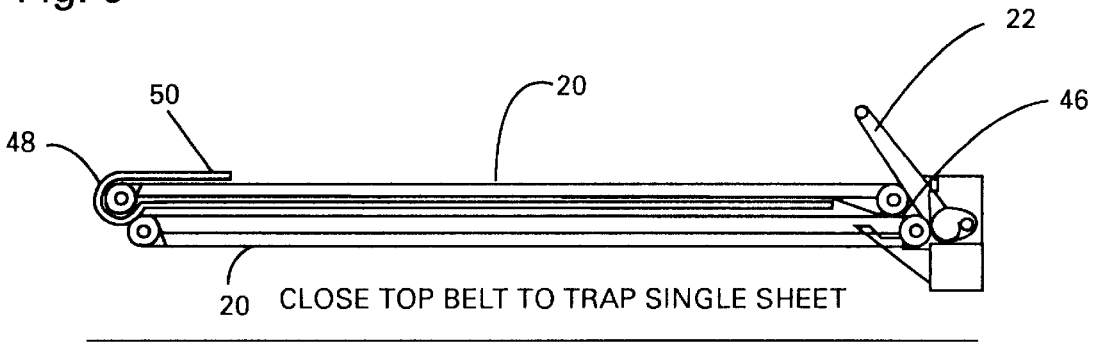
FIG. 6 is a side view as in FIGS. 4 and 5, and shows the moveable upper support tray closed on top of the stationary lower support platform with an end portion of the protective material folded back on top of the moveable upper support tray.

As shown in FIG. 5, once moveable support tray 42 is in the open position, protective material 48 is inserted so as to cover the top of stationary lower support platform 44. As shown in FIG. 5, an end portion 50 hangs over and down from the outward end of stationary lower support platform 44. As shown in FIG. 6, moveable upper support tray 42 is then closed on top of stationary lower support platform 44. Because there are no protruding ridges, beams, support structure, or any other obstructions of any kind in between moveable upper support tray 42 and stationary lower support platform 44, protective material 48 is free to move with the movement of endless moveable belts 20. FIG. 6 shows the end 50 of protective material 48 folded back on top of moveable upper support tray 42's moveable belt 20.

Figure 7:
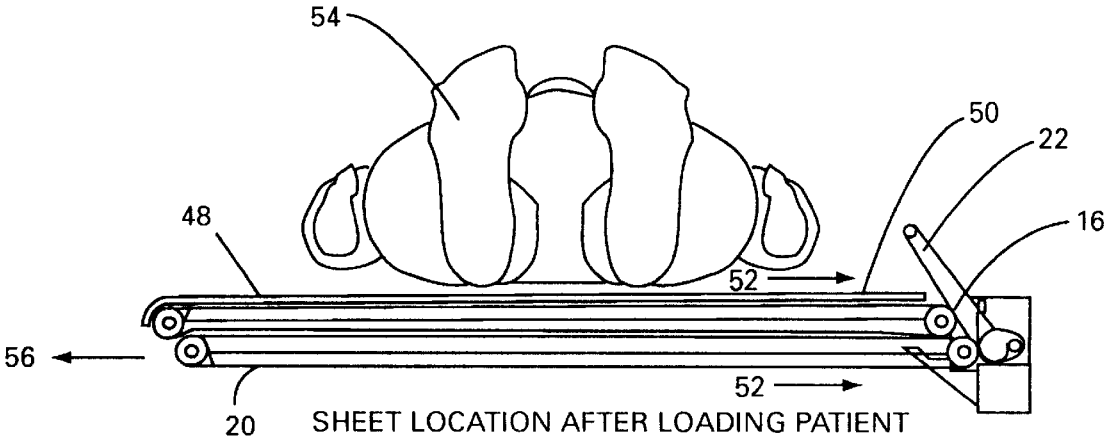
FIG. 7 is a side view as in FIGS. 4, 5, and 6, illustrating the culmination of the simultaneous movement of the dual endless belt means underneath an object to be moved and the insertion of protective material between the object to be moved and the top of the moveable upper support tray.

Referring to FIG. 7, handle 22 is rotated so as to move the pair of endless moveable belts 20 in the direction of arrows 52. While object mover 10 crawls underneath the object to be moved, for example, patient 54, protective material 48 moves in direction of arrow 56 from between moveable upper support tray 42 and stationary lower support platform 44 until end portion 50 having moved in the direction of arrow 52 is close to the handle 22 and counter-rotatable shaft 16. The result is that patient 54 is now supported by the object mover 10, but insulated from the object mover 10, and the object mover 10 is insulated from the patient 54, by means of protective material 48.

Figure 8:
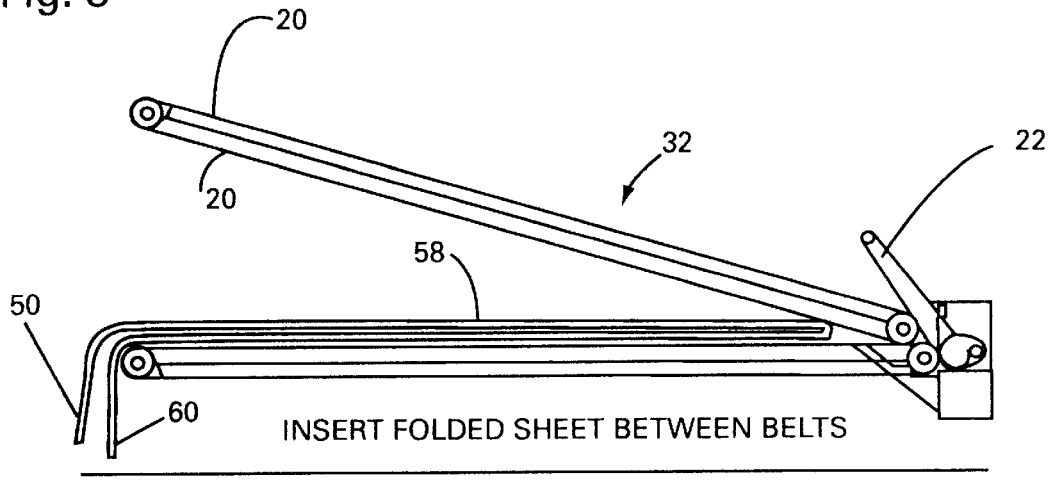
FIG. 8 is a side view illustrating the insertion of a folded protective material with two ends protruding.
Figure 9:
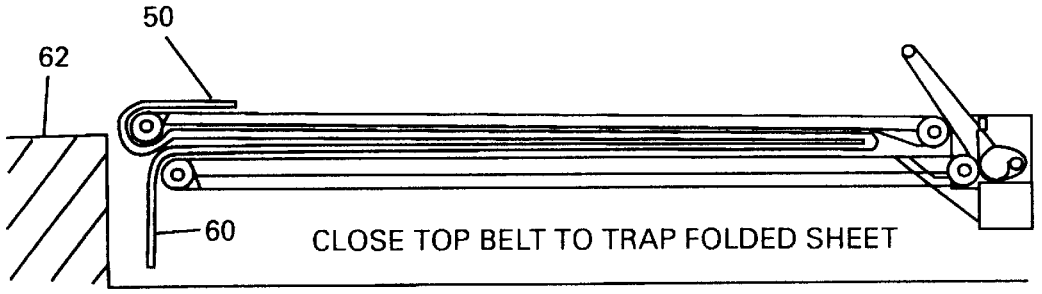
FIG. 9 is a side view as in FIG. 8 of the moveable upper support tray in the closed position with one end of the protective material folded on top of the moveable upper support tray and the other end hanging loose.
Figure 10:
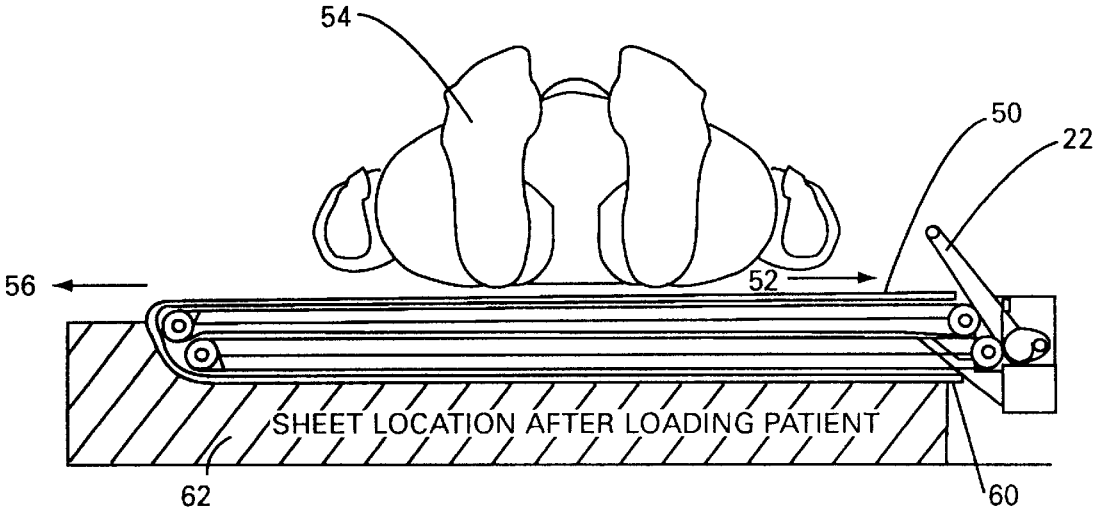
FIG. 10 is a side view as in FIGS. 8 and 9 showing the result of the simultaneous movement of the endless belt means and the object mover beneath the object being moved and the insertion of the protective material between the object to be moved and the top of the moveable upper support tray as well as covering the bottom of the stationary lower support platform thereby protecting it from contact with the surface upon which the object to be moved was formerly resting.

Referring now to FIGS. 8, 9, and 10, another embodiment of the present invention is illustrated wherein protective material 48 is folded as illustrated in FIG. 8. The folded protective material 58 is placed as shown in FIG. 8, with the folded end captured between moveable upper support tray 42 and stationary lower support platform 44 and the two free ends protruding therefrom. Because of the fold, not only end portion 50, but also end portion 60 of protective material 58 extend beyond the ends of the object mover 10. As shown in FIG. 9, end portion 50 is folded on top of endless belt 20 as previously described, but end portion 60 is allowed to hang free. As shown in FIG. 10, when object mover 10 crawls underneath patient 54 in the direction of arrow 56, end portions 50 and 60 move with endless belts 20 in the direction of arrows 52. As a result, not only is patient 54 shielded from contact with object mover 10, but object mover 10 is shielded from contact with bed 62 upon which patient 54 had lain.

Protective material insertion apparatus 32 operates in any manner known in the art, and particularly as disclosed in U.S. Pat. No. 5,540,321, except that contrary to U.S. Pat. No. 5,540,321 moveable upper support tray 42 is not identical to stationary lower support platform 44 as in the prior patented invention and prior art. The prior apparatus included multiple obstructions between the two upper and lower sections, including "side edges 70", among others. Importantly, proper operation of the protective material insertion apparatus 32 requires that protective material 48 and/or folded protective material 58 be free to move with endless belts 20 from a sandwich position between moveable upper support tray 42 and stationary lower support platform 44 which would be impossible with any interior obstructions between the two.

In operation, object mover 10 can be utilized to move any object and, in particular, objects that would be difficult for a single person to move. In the medical business, for example, the movement of patients 54 for other treatment or to clean the bed linen, and so forth, can be accomplished by a single person using object mover 10. Additionally, by means of protective material insertion apparatus 32, the patient 54 is protected from contamination by the object mover 10 and vice versa. Simply opening moveable upper support tray 42 by pivoting on pivotal connection 46 exposes stationary lower support platform 44 and its endless belt 20. Placing protective material 48 between the two, while allowing an end portion 50 to protrude therefrom is the next step. Closing moveable upper support tray 42 onto stationary lower support platform 44 brings both moveable belts 20 in "sandwiching" contact with protective material 48. Curling end portion 50 on top of moveable upper support tray 42 is the next step. It may be that end portion 50 and 60 are held in place by means of a hook and loop attachment, or any other means of attaching, to the moveable belts 20 as deemed appropriate and necessary. However, even without being secured, once in position as illustrated in FIG. 6, the movement of handle 22 so as to move the upper and lower belts 20 in the direction of arrows 52 results in end portion 50 moving in the direction of arrows 52 as object mover 10 crawls underneath patient 54. As a result, patient 54 is isolated and protected from contact with object mover 10, and vice versa.

Alternatively, folded protective material 58 may be utilized so that not only is the moveable belt 20 of moveable upper support tray 42 protected from contact with patient 54, but the moveable belt 20 and stationary lower support platform 44 are protected from contact with bed 62, or any other resting place, of patient 54 and/or any object to be moved.

It is also a feature of the present invention that, with reference to FIGS. 6 and 9, protective material 48 and 58 can be retracted back between moveable upper support tray 42 and stationary lower support platform 44 so long as some portion of protective material 48 and/or 58 remains there between. That is, the user can rotate handle 22 so as to fully eject protective material 48 and 58 or, as desired, can maintain some portion of protective material 48 and 58 between moveable upper support tray 42 and stationary lower support platform 44. If a portion is so retained, then by reversing the direction of handle 22, protective material 48 and/or 58 will be retracted until such material is essentially fully contained there between as illustrated in FIGS. 6 and 9.

While the protective material insertion apparatus of the present invention has been disclosed in connection, in particular, with utilization with hospital patients, it should be appreciated that the object mover and protective material insertion apparatus can be used in other situations. The present invention provides an improved means and method for moving and protecting any object by a single person. Importantly, the invention significantly reduces the chances of passing contaminants from the object mover after use to other objects to be moved.

While the present invention has been disclosed in connection with the preferred embodiment thereof, it should be understood that there may be other embodiments which fall within the spirit and scope of the invention as defined by the following claims.

I claim:

1. An object moving apparatus comprising:

a moveable support stand;

(b) a stationary lower support platform and endless belt means connected to said moveable support stand; and (c) a moveable upper support tray and endless belt means pivotally joined to said stationary lower support platform without interior obstruction so that sheet-like protective material placed between them is free to move whereby when said endless belt means are operated said sheet-like protective material moves between an object to be moved and said moveable support stand.

2. The object moving apparatus of claim 1 wherein the sheet-like protective material comprises one of a group, including foam plastic, absorbent padding, and waterproof sheets.

3. A method of inserting protective material between an object and a moveable support stand comprising the steps of:

(a) connecting a stationary lower support platform and endless belt means to the moveable support stand;

(b) pivotally connecting a moveable upper support tray and endless belt means to the stationary lower support platform without interior obstruction so that protective material placed between them is free to move;

(c) pivoting the moveable upper support tray to an open position;

(d) inserting sheet-like protective material between said moveable upper support tray and said stationary lower support platform;

(e) closing said moveable upper support tray and folding a portion of said protective material on top of said moveable upper support tray; and (f) simultaneously moving said endless belt means and moving said support stand under said object so that as said moveable upper support tray crawls under said object, said protective material moves with the endless belt means between the object and the endless belt means.

4. The method of claim 3 wherein the step of inserting sheet-like protective material further comprises the step of inserting a folded protective material with two free ends protruding, one folded on top of said moveable upper support tray and one below said stationary lower support platform, so that after the object is moved onto the moveable upper support tray, the protective material is between the object and covers the moveable upper support tray and the stationary lower support platform.

* * * * *